US006986442B2

(12) United States Patent
Engel et al.

(10) Patent No.: US 6,986,442 B2
(45) Date of Patent: Jan. 17, 2006

(54) METHOD AND APPARATUS FOR BLENDING AND DISPENSING LIQUID COMPOSITIONS

(75) Inventors: Steven P. Engel, Rockford, MI (US); Jesse C. Leverett, Rockford, MI (US); Prakash Desai, San Jose, CA (US); Michael K. Brown, Sunnyvale, CA (US)

(73) Assignee: Access Business Group International LLC, Ada, MI (US)

( * ) Notice: Subject to any disclaimer, the term of this patent is extended or adjusted under 35 U.S.C. 154(b) by 18 days.

(21) Appl. No.: 10/785,670

(22) Filed: Feb. 24, 2004

(65) Prior Publication Data

US 2004/0164096 A1 Aug. 26, 2004

Related U.S. Application Data

(63) Continuation of application No. 10/153,373, filed on May 22, 2002, now Pat. No. 6,715,642.

(60) Provisional application No. 60/292,752, filed on May 22, 2001.

(51) Int. Cl.
*B67D 5/08* (2006.01)

(52) U.S. Cl. ..... 222/63; 222/132; 132/314

(58) Field of Classification Search ..... 222/132; 132/73, 200, 285
See application file for complete search history.

(56) References Cited

U.S. PATENT DOCUMENTS

| | | | | |
|---|---|---|---|---|
| 3,760,986 A | | 9/1973 | Castner et al. | |
| 3,946,398 A | | 3/1976 | Kyser et al. | |
| 4,314,653 A | | 2/1982 | Sindoni | |
| 4,637,527 A | | 1/1987 | Arrigoni | |
| 5,063,396 A | | 11/1991 | Shiokawa et al. | |
| 5,390,453 A | | 2/1995 | Untiedt | |
| 5,411,176 A | | 5/1995 | Favre | |
| 5,605,255 A | | 2/1997 | Reidel et al. | |
| 5,816,445 A | | 10/1998 | Gardos et al. | |
| 5,848,732 A | | 12/1998 | Brugger | |
| 5,887,761 A | | 3/1999 | Foster et al. | |
| 5,894,841 A | | 4/1999 | Voges | |
| 5,931,166 A | * | 8/1999 | Weber et al. | 132/73 |
| 5,938,080 A | | 8/1999 | Haaser et al. | |
| 5,967,372 A | | 10/1999 | Favre | |
| 5,971,210 A | | 10/1999 | Brugger | |
| 5,975,675 A | | 11/1999 | Kim | |
| 6,029,857 A | | 2/2000 | Keller | |
| 6,067,996 A | | 5/2000 | Weber et al. | |

(Continued)

FOREIGN PATENT DOCUMENTS

EP 0 443 741 A1 8/1991

(Continued)

*Primary Examiner*—Philippe Derakshani
(74) *Attorney, Agent, or Firm*—Alticor Inc.

(57) ABSTRACT

The present invention is directed to a multi-chambered dispenser for blending and dispensing a customized liquid product such as a liquid cosmetic foundation. The dispenser includes a device for selecting a customized liquid formula; a plurality of cartridges separately containing pre-mix compositions for the customized liquid product; at least one ink jet head in fluid communication with the cartridges; a central processing unit for processing the customized liquid formula and activating the ink jet head; whereby the ink jet head dispenses the pre-mix compositions in accordance with the customized liquid formula to provide a customized liquid product.

3 Claims, 7 Drawing Sheets

U.S. PATENT DOCUMENTS 6,161,730 A 12/2000 Heusser et al.
6,202,895 B1 3/2001 Fox
6,216,915 B1 4/2001 Harman et al.
6,216,966 B1 4/2001 Prendergast et al.
6,273,298 B1 8/2001 Post
6,286,517 B1 * 9/2001 Weber et al. ..... 132/73
6,325,475 B1 12/2001 Hayes et al.
6,328,182 B1 12/2001 Brugner
6,715,642 B2 * 4/2004 Engel et al. ..... 222/63

FOREIGN PATENT DOCUMENTS

WO WO 99/64570 11/2000

* cited by examiner

METHOD AND APPARATUS FOR BLENDING AND DISPENSING LIQUID COMPOSITIONS

RELATED APPLICATIONS

This application is a continuation of U.S. Ser. No. 10/153,373 filed May 22, 2002, now U.S. Pat. No. 6,715,642, the contents of which are incorporated herein by reference in its entirety.

FIELD OF THE INVENTION

The present invention relates to blending and dispensing devices. More particularly, the present invention relates to blending and dispensing devices for liquid compositions including, among other products, various shades of liquid cosmetic compositions.

BACKGROUND OF THE INVENTION

Colored liquid cosmetics such as lipstick, lip gloss, tinted creme, foundation, eyeliner, and nail polish are desired in numerous shades to fit the preferences of various consumers. For example, more than 20 shades of liquid foundation may be popular in a season and desired to suit different skin tones that exist in the public. Thus, it is necessary that foundation manufacturers mix more than 20 shades of foundation in manufacturing plants to satisfy the public's desires. It is also necessary that a consumer purchase a separate bottle of each desired shade.

The prior art suggests how the cosmetics industry might eliminate the need to purchase separate bottles of foundation for each shade a consumer desires. In particular, a consumer may mix his/her personal shade of colors at home by using one of the prior art multi-chambered dispensers. Past multi-chambered cosmetic dispensers generally utilize a mechanical pump means. Examples of typical multi-chambered fluid dispenser are disclosed in U.S. Pat. Nos. 5,848,732 and 3,760,986. U.S. Pat. No. 3,760,986 discloses a multi-chambered dispenser that is operated by a positive displacement pump. The dispenser comprises separate non-communicating compartments and a tube extending from each compartment into a chamber in the nozzle head. The positive displacement pump has two spaced pistons and two spring-loaded ball checks for closing the connection between the chamber and the depending tube in each chamber. As the user depresses the pump, the spring-loaded ball is displaced so that fluid from each compartment can separately pass into the chamber and out the nozzle head. U.S. Pat. No. 5,848,732 discloses a similar mechanical multi-chambered dispenser with a positive displacement pump. However, the dispenser disclosed in U.S. Pat. No. 5,848,732 utilizes a mixing apparatus having a manual adjuster for changing the amount of medium dispensed from each compartment into a mixing chamber. After the medium is mixed, the medium exits the dispenser.

One problem with past multi-chambered dispensers is that the dispenser is a pump that typically comprises a plastic piston and a spring-loaded ball which both tend to wear out or break after continued use, causing the dispenser to malfunction. Another problem with past multi-chambered dispensers is that mechanical pumps limit a user to fixed increments of product from each chamber of the dispenser. In relation, the manually operated mechanical pumps do not successfully dispense micro-liter volumes of liquid from each compartment or dispense precise doses of product after repeated use. Thus, if the past multi-chambered dispenser is used to mix colored products, one dispenser would not achieve every color in the visible color spectrum. Further, a pump style dispenser can be messy because a user has to pour liquid foundation or other fluids into the chambers each time the fluids are depleted. The conventional dispensers also do not effectively use up all of the foundation in the dispensers because the tubes in which the foundation is pulled up into do not pull fluid off of the dispenser walls.

Therefore, there remains a need to provide a dispenser for dispensing liquid cosmetic compositions that is cost effective, durable, and dispenses doses of product in non-limiting and accurate increments. There also remains a need to provide a dispenser that dispenses an infinite number of shades of cosmetics.

SUMMARY OF THE INVENTION

The present invention overcomes the shortcomings associated with previous multi-chambered dispensers by providing a multi-chambered dispenser for dispensing customized fluid compositions using ink jet printing technology. The present invention includes a housing defining a dispensing orifice, a device to specify the customized liquid formula, a central processing system including stored formulas, a power source, multiple cartridges, and at least one ink jet head for dispensing programmed volumes of the customized liquid formula. In one embodiment, the dispenser is made to dispense customized shades of liquid foundation. Utilizing ink jet printing technology for dispensing liquid cosmetic compositions is a surprising aspect of the present invention because ink that is used in ink jet printers is much more fluid than typical liquid cosmetic compositions. It was believed that the rheology of cosmetic fluids, such as liquid foundation, would not properly flow through the ink jet cartridges.

These and other aspects and advantages of the invention will be better understood upon review of the following description, pending claims, and accompanying sheets of drawings.

DETAILED DESCRIPTION OF THE PREFERRED EMBODIMENT

The present invention uses ink jet printing technology to dispense a variety of compositions including, but not limited to, fluids containing vitamins, minerals, or fluoride for use in connection with water treatment systems, liquid cosmetics such as lipstick, lip gloss, eyeliner, and blush; fragrances; personal care products such as lotions, creams, moisturizers, and sunscreens; and home care products such as multi-purpose cleaners and air fresheners. The ink jet head may use a magneto-restrictive alloy, thermal, solenoid, or piezo-electric technology. For purposes of illustrating the present invention in detail, an exemplary piezoelectric system for custom formulating liquid foundation will be described. Piezoelectric technology uses piezo crystals which receive a tiny electric charge causing the crystals to vibrate. At one instance, the crystal pulls back to allow fluid into the reservoir. At another instance, the crystal fires back into its original position exerting a mechanical pressure on the fluid which forces a tiny amount of fluid out of the nozzle. The typical ink jet head forces out small droplets of fluid, generally between 50 to 60 microns in diameter.

Figure 1:
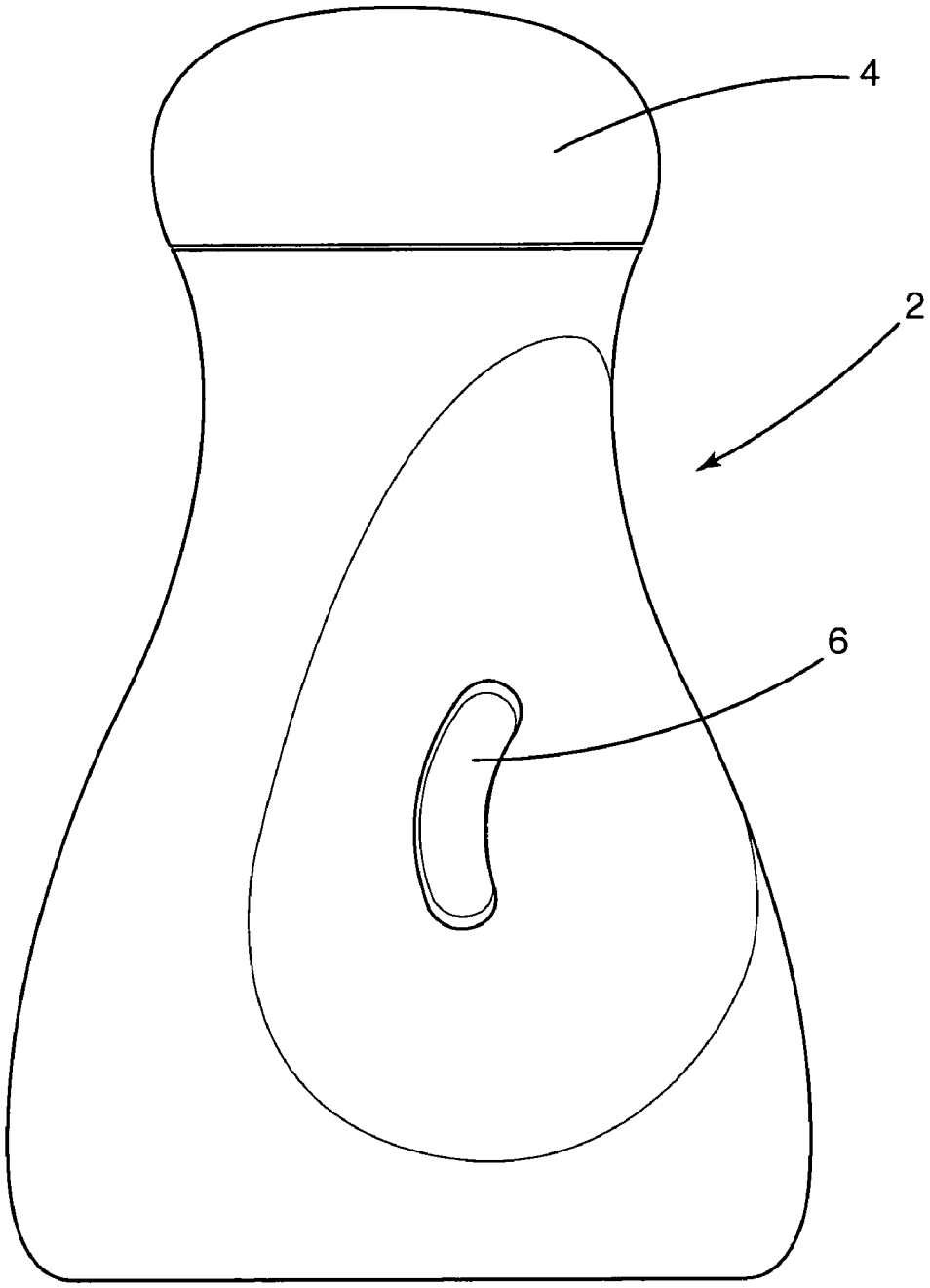
FIG. 1 is a front planar view of one embodiment of the dispenser.
Figure 2:
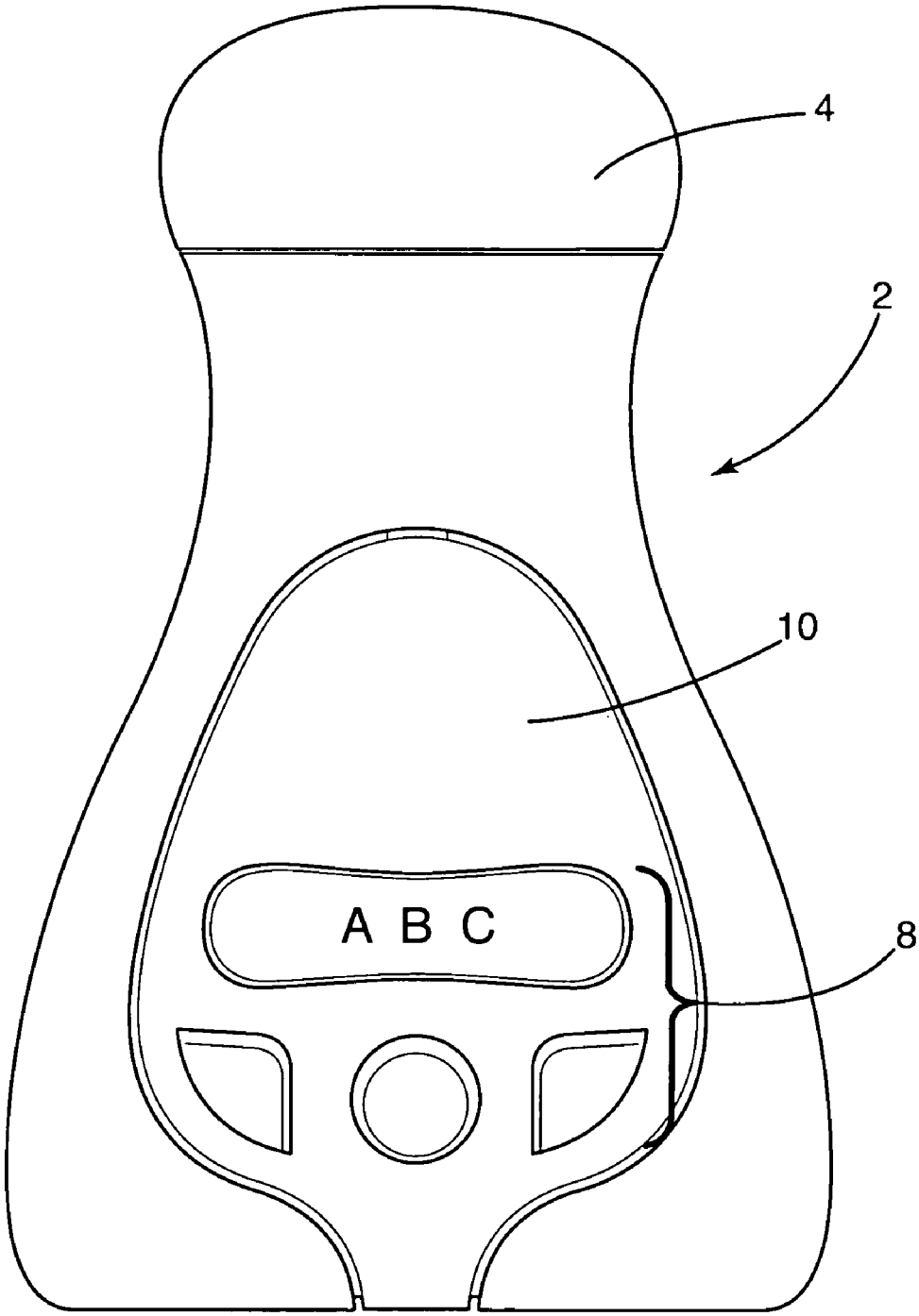
FIG. 2 is a back view of the dispenser in FIG. 1.
Figure 3:
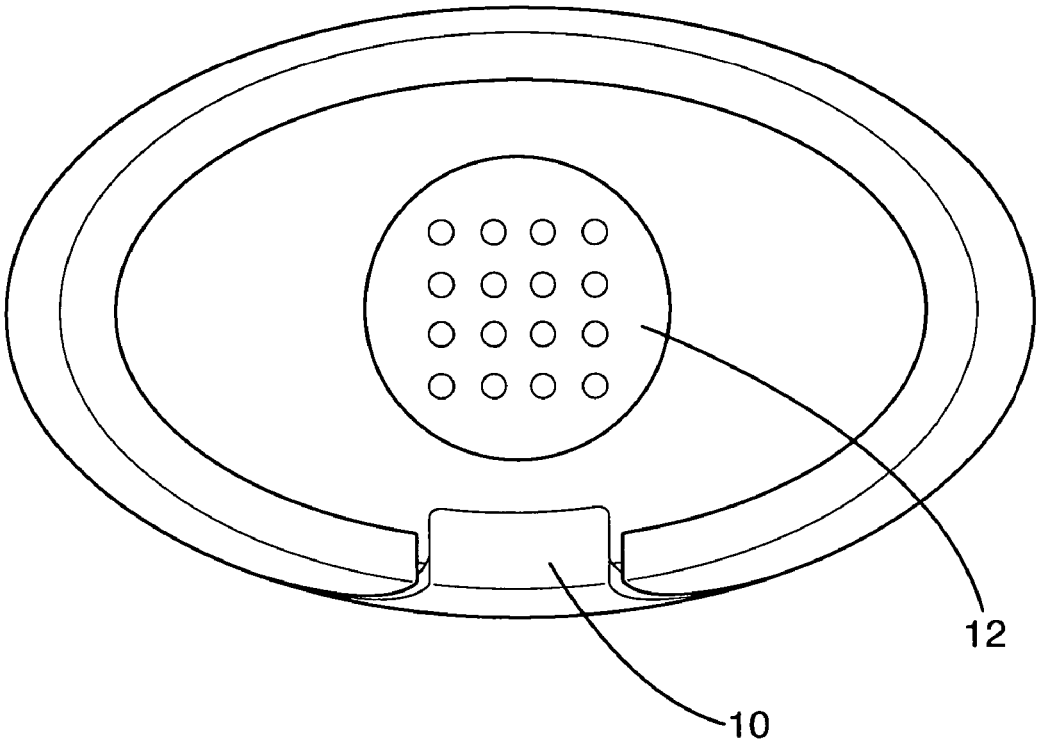
FIG. 3 is a bottom view of the dispenser in FIG. 1.

Now referring to FIG. 1, a perspective view of one embodiment of the multi-chambered dispenser 2 is shown. The dispenser 2 has a cap 4 and a power button 6. FIG. 2 shows the back view of the dispenser. The dispenser has a device or control panel 8 for specifying a shade of liquid cosmetic. The control panel 8 may include several buttons that function to increase or decrease the amount of liquid that is dispensed from the cartridges 14*a*–14*d*. A removable cover or door 10 may partially or wholly cover the control panel 8. FIG. 3 shows the bottom view of the dispenser 2 showing a dispensing port 12.

Figure 4:
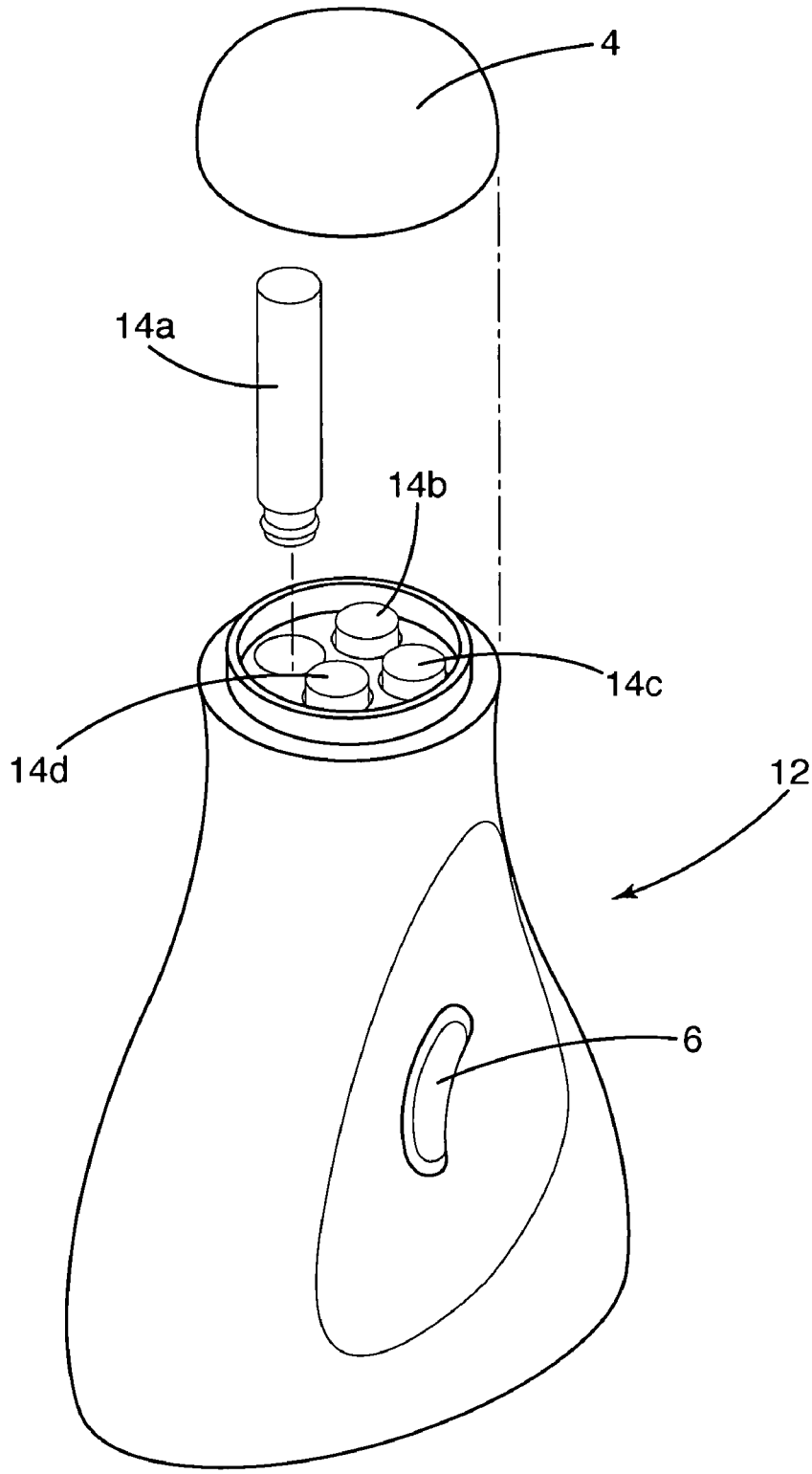
FIG. 4 is an exploded view of the dispenser in FIG. 1.

Referring to FIG. 4, the multi-chambered dispenser 2 houses four cartridges 14*a*, 14*b*, 14*c*, 14*d* that contain a different color of liquid foundation. Each cartridge 14*a*–14*d* may hold about 1 ml to about 15 ml of liquid foundation. The cartridges 14*a*–14*d* are pressurized so the liquid foundation contained therein can easily pass out of the cartridges 14*a*–14*d* and into its corresponding flow path 16 shown in FIG. 5.

Figure 5:
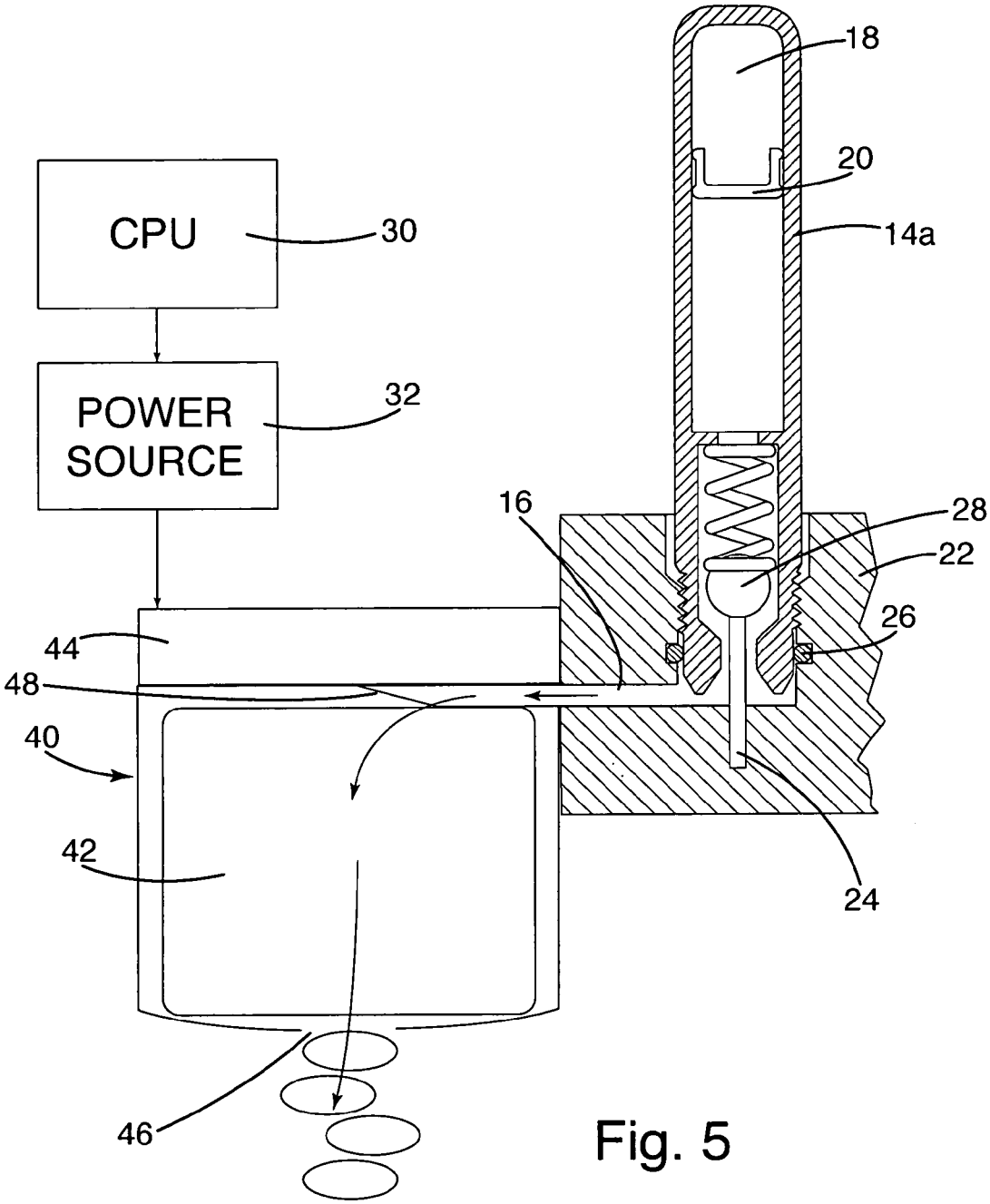
FIG. 5 is a schematic cross-sectional view of a cartridge, flow path, and piezoelectric ink jet head.

FIG. 5 is a schematic drawing of a piezoelectric system showing only one cartridge 14*a* and corresponding flow path 16 and a piezoelectric ink jet head 40. Although the four cartridges 14*a*–14*d* in FIG. 4 are not shown, this schematic drawing generally applies to each cartridge 14*a*–14*d*. Each flow path 16 empties into a corresponding chamber 42. The cartridges 14*a* may also include a plunger 20 for assisting in dispensing liquid from the cartridge to the flow path 16. Preferably, pressurized gas is disposed in a compartment 18 behind the plunger 20 to apply a force to the plunger 20. In some applications, the pressurized gas can be replaced by a spring or other conventional biasing mechanism. Alternatively, the cartridge 14*a* may use capillary action to move the liquid foundation into the ink jet head 40. The cartridge receiving end 22 of the flow path 16 may include a rod shaped plug 24 that breaks the cartridge seal when the cartridge 14*a* is coupled to the receiving end 22 of the flow path 16 as well as an o-ring 26. O-ring 26 surrounds the outside of the cartridge to prevent the liquid from leaking out around the edge of the cartridge 14*a*. The seal may be a spring-loaded ball 28 as shown in FIG. 5, a conventional foil seal, or natural surface tension. The cartridge 14*a* may be threaded or otherwise coupled to the receiving end 22 of the flow path 16.

In another embodiment of the present invention, one cartridge 14*a* may feed into multiple ink jet heads 40. For example, each cartridge 14*a*–14*d* might have three flow paths 16, each leading into a separate ink jet head 40 (not shown). These multiple ink jet heads 40 are configured such that the colors of the liquid foundation are interlaced. Because ink jet print heads dispense extremely small dots of color onto a printing surface, typically between 50 and 60 microns in diameter (which is smaller than the diameter of a human hair), dispersal of interlaced colors of foundation in the palm of a user's hand will provide a more blended appearance than a non-interlaced pattern. An example of an interlaced pattern is illustrated below:

| | | |
|---|---|---|
| White | Black | Yellow |
| Black | White | Red |
| Yellow | Red | White |

In yet another embodiment, the orifice 46 of each ink jet head is angled such that each foundation color collides with another color upon dispersal out of the orifice 46 (not shown). In still yet another embodiment, the orifice 46 of ink jet head 40 is fluidly connected to a corresponding exit flow path. Each exit flow path merges into a single mixing chamber allowing the colors to be mixed before exiting the dispensing port 6 (not shown).

It will be apparent to those skilled in the art that depending on the type of composition dispensed from the present device, the number of cartridges will vary to satisfy the various shade, nutrients, sunscreen, or fragrances desired for that liquid composition. For example, if a dispenser for customized levels of sunscreen protection is manufactured, there may be a cartridge for the UVA/UVB protectant composition and a cartridges for the other ingredients. The dispersal of UVA/UVB would differ for each level of sunscreen a user desires. Another example is water treatment systems having the present invention to add desired vitamins and minerals. A separate cartridge may exist for the various vitamins and minerals so a user can choose a desired formula for the water he/she obtains from the water treatment system. For liquid foundation, the colors that are necessary to achieve the array of shades to match various skin tones are red, white, yellow, and black. Preferred ratios of the red, white, yellow, and black foundation pre-mixes for exemplary shades are as follows. All percentages are by total weight unless otherwise indicated.

TABLE 1

| | Desired Amount of Foundation Pre-Mix | | | |
|---|---|---|---|---|
| Desired Shade | White | Red | Yellow | Black |
| Ivory | 95.50% | 0.90% | 3.60% | 0.00% |
| Fresh Bisque | 89.87% | 2.43% | 6.40% | 1.30% |
| Natural | 84.58% | 3.42% | 9.90% | 2.10% |
| Honey Crème | 84.20% | 3.60% | 10.60% | 1.60% |
| True Beige | 80.29% | 5.31% | 12.50% | 1.90% |
| Mocha | 26.17% | 21.09% | 40.47% | 12.27% |
| Deep Mahogany | 0.82% | 26.98% | 38.75% | 33.45% |

Formula examples for the foundation pre-mixes are shown in Table 2.

TABLE 2

| White Pre-mix (Water in Cyclomethicone) | |
|---|---|
| In The Oil Phase | |
| Cyclomethicone | 11.75 |
| Cyclomethicone (and) Dimethicone Copolyol | 10.00 |
| Sorbitan Trioleate | 0.20 |
| Tocopheryl Acetate | 0.25 |
| Acrylates Copolymer (and) Cyclomethicone | 10.00 |

TABLE 2-continued

| | |
|---|---|
| Colorant Section | |
| Iron Oxides, Titanium Dioxide (and) Magnesium Myristate | 10.00 |
| Active Ingredient | |
| Zinc Oxide (and) Dimethicone, Hydrophobic Ultra Fine | 3.0 |
| Phenylbenzimidazole Sulfonic Acid | 3.00 |
| Triethanolamine | 1.93 |
| Methylparaben | 0.20 |
| Propylparaben | 0.06 |
| Glycerin, 96% | 2.00 |
| Green Tea Extract in Butylene Glycol | 1.00 |
| Lactobacillus/Acerola Cherry Ferment | 1.00 |
| Alpha-Glucan Oligosaccharide | 2.00 |
| PEG-150/Decyl Alcohol/SMDI Copolymer in Propylene Glycol and Water | 1.00 |
| Benzyl Alcohol | 1.00 |
| In the Water Phase | |
| Water, Purified | 41.61 |
| TOTAL | 100% |
| Red Pre-Mix (Suspension) | |
| DI Water | 79.60% |
| Gellan Gum (Kelco Gel) (Monsanto) | 0.20 |
| Red Iron Oxide (RND-DC00) 49.1% solids (Sun Chemical) | 20.00 |
| Diazolidinyl Urea (and) Iodopropynyl Butylcarbamate | 0.20 |
| TOTAL | 100% |
| Yellow Pre-Mix (Water in Oil Emulsion) | |
| In the Water Phase | |
| Purified Water | 49.10% |
| Sodium Chloride | 0.50 |
| Disodium EDTA | 0.20 |
| Diazolidinyl Urea and Iodopropynyl Butylcarbamate | 0.20 |
| Colorant Section | |
| Yellow I.O./Isononyl Isononanoate/ Isopropyl Titanium Triisostearate (Kobo) | 14.81 |
| In the Oil Phase | |
| PEG-30 Dipolyhydroxystearate | 3.00 |
| Polyglyceryl-2 Triisostearate | 2.00 |
| Isononyl Isononanoate | 30.19 |
| TOTAL | 100% |
| Black Pre-Mix (Oil in Water Emulsion) | |
| In the Water Phase | |
| DI Water | 66.73% |
| Disodium EDTA | 0.15 |
| Glycereth-26 | 3.00 |
| Xanthan Gum | 0.15 |
| In the Oil Phase | |
| Capric/Caprylic Triglycerides | 5.10 |
| Isononyl Isononaoate | 5.10 |
| Polyglyceryl-2 Triisostearate | 1.82 |
| Polysorbate 60 | 1.75 |
| Colorant | |
| Iron Oxide and Isononyl Isononanoate and Titanium Triisostearate (Kobo) | 16.00 |
| Diazolidinyl Urea and Iodopropynyl Butylcarbamate | 0.20 |
| TOTAL | 100% |

For the typical foundation in the medium range of shades, the most dominant color is white. Although it takes white, yellow, red and black to permit the system to make all shades, most shades are predominantly white. If four cartridges of equal volume containing foundations of white, yellow, red and black were used to formulate the most common shades, white would be depleted very rapidly with black far outlasting the other colors. To account for this, a manufacturer may premix white with the other colors in an inverse ratio to frequency of use. For example, white would be 100% white, yellow would be approximately 50% white and 50% yellow, red would be 35% red and 65% white, and black would be 20% black and 80% white. In this way, a fairly even use up rate can be achieved for all colors.

Still referring to FIG. 5, when a user of the present invention uses the control panel 8 to input a formula comprising a ratio of each foundation from the cartridge, the formula is received by a microprocessor ("CPU") 30. The CPU 30 processes the inputted information and controls the amount of power generated from the power source 32 in activating the ink jet head 40. Fluid in the chamber 42 of the ink jet head 40 is subsequently dispelled by a change in the momentum of a momentum transferring device such as a piezo crystal 44 which is opposite the orifice 46 of the ink jet head 40. This abrupt change in momentum is conferred to the static liquid within the chamber 42 causing it to assume this momentum and propel from the orifice 46. A typical orifice of an ink jet head is about 0.002 inches in diameter. The orifice 46 of an ink jet head for dispensing liquid foundation is preferably about 0.007 inches to about 0.008 inches in diameter. Further, due to the rheology of liquid foundation, it is preferable to incorporate more than one momentum transferring device to assist in propelling fluid out of the chamber 42. The size of the orifice 46 and the use of multiple momentum transferring devices are distinctions in the present invention from conventional ink jet technology. This momentum can be conferred by a thermal system, solenoid actuator, piezo crystal or magneto-restrictive alloy. Any combination of the aforementioned momentum transferring devices can be employed in the present invention.

FIG. 5 is a piezoelectric ink jet head 40 for the present invention and uses a piezo crystal 44. The ink jet head 40 includes a piezo crystal 44 that reacts to an electrical impulse communicated through the CPU 30 by the power source 32. When the piezo crystal 44 receives the electrical impulse, the impulse reconfigures the piezo crystal 44. The continual reconfiguration results in the piezo crystal 44 oscillating up and down. The piezo crystal 44 may oscillate at about 2,000 Hertz via electrical impulse from the power source 32. The liquid foundation enters the ink jet head through a one way path on the uppermost layer of the piezo crystal 44. A flexible film 48 may be provided near the entry of the chamber 42 of the ink jet head 40 to assist in controlling the flow of liquid foundation through the flow path 16 and chamber 42 until it reaches the orifice 46. The force of the piezo crystal 44 while oscillating in a downward direction assists in transferring the liquid foundation out the orifice 46 of the ink jet head 40. The piezo crystal 44 in this embodiment acts as the momentum transferring device.

Because the fluid is not being actively pumped from a nozzle, measuring the quantity of dispensed fluid is preferably not achieved by using a flow meter. Rather, in a preferred embodiment, metering relies on a calculation of the volume of the chamber 42 in relation to the number of times it is struck by the momentum transferring device. Some work may go into making sure that liquids of varying rheology consistently dispense with a fixed volume. Once this volume is known, one can achieve a desired ratio of liquids simply by controlling the oscillations of the momentum transferring device.

In a preferred embodiment, the liquid foundation dispenses from the orifice 46 in the form of spherical droplets of finite volume. In a preferred embodiment, there are approximately 50,000 drops that total approximately 0.1 ml for each cycle or for each time a user activates the dispenser. Exemplary drops for each pre-mix foundation and volume of premix per drop for sample colors are shown in Table 3. This table represents values achieved in a preferred embodiment. Droplet size may vary from application to application depending on the characteristics of the ink jet head (e.g. ink jet orifice diameter) and the dispensed liquid (e.g. rheology and viscosity). The values in Table 3 are achieved by an enlarged ink jet having an orifice diameter of about 0.007 to about 0.008 inches.

information may be stored in the computer's hardware, software, or a website set up for the current dispenser. It is also contemplated that the computer having the stored formula information may be a colorimeter or a spectrophotometer. The dispenser may have a plug-in for hooking the computer up to the dispenser, such as a USB port, serial port, parallel port or other communications port. In operation, the user might choose a shade using the computer which would then download the particular formula into a CPU in the dispenser for immediate dispensing of the desired shade. The computer may include a database of pre-created formula or may create the formula in real time through user interaction. The computer may also permit the user to directly enter a formula. The dispenser CPU may include software for converting formulae received from the computer into ink jet head instructions. Alternatively, the computer may convert the formulae into ink jet head instructions that are transmitted to and executed by the dispenser CPU.

Additionally, it is envisioned that the present invention can be programmed by a personal data assistant using infrared technology whereby the user can input the desired formula into the personal data assistant and transmit that data through an infrared receiving port of the multi-chambered dispenser.

While in the foregoing specification this invention has been described in relation to certain preferred embodiments thereof, and many details have been set forth for the purpose of illustration, it will be apparent to those skilled in the art that the invention is susceptible to alteration and that certain other details described herein can vary considerably without departing from the basic principles of the invention.

TABLE 3

| | White | | Red | | Yellow | | Black | |
|---|---|---|---|---|---|---|---|---|
| Desired Shade | Drops | Vol. | Drops | Vol. | Drops | Vol. | Drops | Vol. |
| Ivory | 47,750 | 0.0955 | 450 | 0.0009 | 1,800 | 0.0036 | 0 | 0.0 |
| Fresh Bisque | 44,935 | 0.0899 | 1,215 | 0.0024 | 3,200 | 0.0064 | 650 | 0.0013 |
| Mocha | 13,085 | 0.0262 | 10,545 | 0.0211 | 20,235 | 0.0405 | 6,135 | 0.0123 |
| Dk. Mahogany | 410 | 0.0008 | 13,490 | 0.0270 | 19,375 | 0.0388 | 16,725 | 0.0335 |

Figure 6:
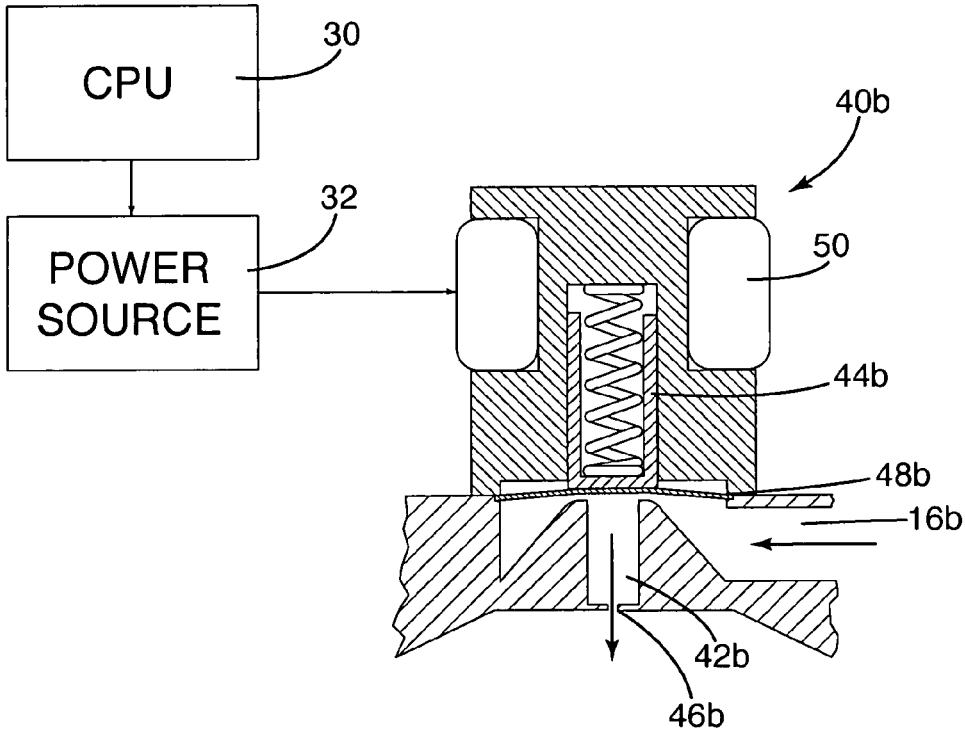
FIG. 6 is a schematic cross-sectional view of a solenoid ink jet head.

Other types of ink jet head systems may be employed for the present invention. FIG. 6 shows a single solenoid ink jet head 40*b*. In this embodiment, the momentum transferring device is a solenoid actuator 44*b*. The electrical impulse from the power source 32 activates a coil 50 that generates a magnetic field, causing the solenoid actuator 44*b* to draw into the coil 50. A flexible film 48*b* may be provided near the entry of the chamber 42*b* of the ink jet head 40*b* to assist in controlling the flow of liquid foundation through the flow path 16*b* and the chamber 42*b* until it reaches the orifice 46*b*. When the solenoid actuator 44*b* releases from the coil 50, the solenoid actuator 44*b* assists in forcing the liquid foundation out of the orifice 46*b*.

Figure 7:
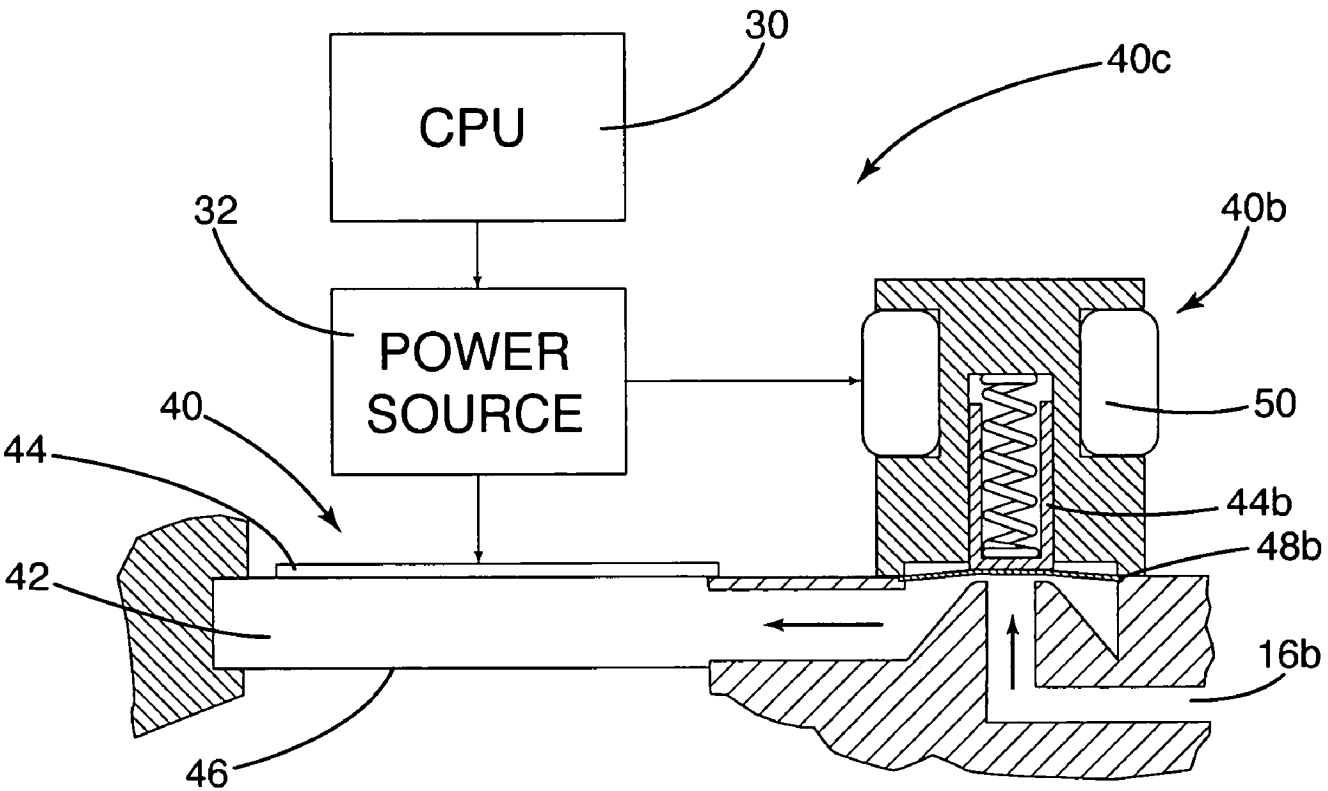
FIG. 7 is a schematic cross-sectional view of a dual valve solenoid-piezo ink jet head system.

FIG. 7 shows a dual valve solenoid-piezo embodiment of an ink jet head 40*c*. In this embodiment, a piezoelectric ink jet head 40 is used in combination with a solenoid ink jet head 40*b*. The liquid foundation flows into the solenoid ink jet head 40*b* and then into the piezoelectric ink jet head 40 for final momentum out of the orifice 46. Similarly, other multi valve ink jet systems can be employed for the present invention. One with ordinary skill in the art will appreciate that any combination of thermal, piezo, solenoid, and magneto-restrictive alloy may be incorporated into the ink jet head.

It is envisioned that the present invention is adapted to be connected to a stand alone or remote computer. Formula

We claim:

1. A hand-held multi-chambered dispenser for dispensing a customized fluid composition comprising:

a plurality of cartridges each containing a pre-mix composition;

a plurality of ink jet heads in fluid communication with plurality of cartridges;

a mixing chamber in fluid communication with the plurality of ink jet heads, wherein the mixing chamber blends the pre-mix compositions to form the customized fluid composition; and a dispensing port for dispensing the customized fluid composition, wherein the customized fluid composition is selected from the group consisting of liquid foundations, vitamins, minerals, sunscreens, lotions, creams, and household cleaners.

2. The dispenser of claim 1 further comprising a plurality of orifices in fluid communication with the cartridges, wherein the orifices are configured such that the pre-mix composition collides with one another when exiting the plurality of orifices.

3. The dispenser of claim 1 wherein the customized fluid composition is a liquid foundation.

* * * * *